US007611283B2

(12) United States Patent
Anderson

(10) Patent No.: US 7,611,283 B2
(45) Date of Patent: Nov. 3, 2009

(54) AIRTIGHT ZIPPER

(75) Inventor: Brent Anderson, Barrington, IL (US)

(73) Assignee: CTI Industries, Inc., Barrington, IL (US)

( * ) Notice: Subject to any disclaimer, the term of this patent is extended or adjusted under 35 U.S.C. 154(b) by 434 days.

(21) Appl. No.: 10/661,684

(22) Filed: Sep. 11, 2003

(65) Prior Publication Data

US 2005/0063620 A1 Mar. 24, 2005

(51) Int. Cl.
*B65D 33/16* (2006.01)
*B65D 77/18* (2006.01)
*B31C 1/06* (2006.01)

(52) U.S. Cl. ..... 383/63; 24/30.5 R; 493/297

(58) Field of Classification Search ..... 383/63, 383/59, 68; 24/584.1, 585.12, DIG. 50, 30.5 R; 493/297
See application file for complete search history.

(56) References Cited

U.S. PATENT DOCUMENTS 3,372,442 A * 3/1968 Ishimatsu ..... 24/585.12
3,410,327 A * 11/1968 Ausnit ..... 383/65
3,416,199 A * 12/1968 Imamura ..... 24/585.12
3,790,992 A 2/1974 Hertz
3,839,128 A * 10/1974 Arai ..... 156/461
3,986,914 A 10/1976 Howard
4,186,786 A * 2/1980 Kirkpatrick ..... 383/63
4,212,337 A * 7/1980 Kamp ..... 383/63
4,285,105 A * 8/1981 Kirkpatrick ..... 24/585.12
4,363,345 A * 12/1982 Scheibner ..... 383/63
4,516,268 A * 5/1985 Kamp ..... 383/63
4,523,918 A 6/1985 Ausnit
4,534,752 A 8/1985 Ferret et al.
4,620,320 A 10/1986 Sullivan
4,731,911 A * 3/1988 Gould ..... 24/585.12
5,020,194 A 6/1991 Herrington et al.
5,046,300 A * 9/1991 Custer et al. ..... 53/412
5,067,208 A 11/1991 Herrington et al.
5,088,971 A 2/1992 Herrington et al.
5,127,208 A * 7/1992 Custer et al. ..... 53/412
5,131,121 A 7/1992 Herrington et al.
5,161,286 A 11/1992 Herrington et al.
5,215,380 A * 6/1993 Custer et al. ..... 383/203
5,276,950 A * 1/1994 Johnson ..... 24/585.12
5,301,395 A 4/1994 Richardson et al.
5,405,478 A 4/1995 Richardson et al.
5,426,830 A 6/1995 Richardson et al.
5,442,837 A 8/1995 Morgan
5,448,807 A 9/1995 Herrington, Jr.
5,462,360 A * 10/1995 Tilman et al. ..... 383/63
5,482,375 A 1/1996 Richardson et al.
5,669,715 A 9/1997 Dobreski et al.
5,722,128 A 3/1998 Toney et al.
5,729,876 A * 3/1998 Johnson ..... 24/587.1
5,769,772 A 6/1998 Wiley
5,809,621 A 9/1998 McCree et al.
5,833,791 A 11/1998 Brynairski et al.

(Continued)

*Primary Examiner*—Jes F Pascua
(74) *Attorney, Agent, or Firm*—Joseph A. Fuchs; Rockey, Depke & Lyons, LLC

(57) ABSTRACT

The present invention provides a zippered closure comprising a front zipper profile and a back zipper profile. The front and back zipper profiles each have a facing side and an attaching side. The front and back zipper profiles interlock along their facing sides. The facing side of at least one of the front and back zipper profiles is wider than its attaching side.

15 Claims, 5 Drawing Sheets

U.S. PATENT DOCUMENTS 5,836,056 A 11/1998 Porchia et al.
5,896,627 A 4/1999 Cappel et al.
5,924,173 A 7/1999 Dobreski et al.
5,947,603 A 9/1999 Tilman
5,950,285 A 9/1999 Porchia et al.
5,956,815 A 9/1999 O'Connor et al.
5,991,980 A 11/1999 Meager
6,138,329 A * 10/2000 Johnson ..... 24/584.1
6,167,597 B1 * 1/2001 Malin ..... 24/585.1
6,178,602 B1 1/2001 Burke et al.
6,286,189 B1 9/2001 Provan et al.
6,286,191 B2 9/2001 Van Erden
6,286,999 B1 9/2001 Cappel et al.
6,287,001 B1 9/2001 Buchman
6,293,701 B1 9/2001 Tomic
6,327,754 B1 12/2001 Belmont et al.
6,347,437 B2 2/2002 Provan et al.
6,357,914 B1 3/2002 Kinigakis et al.
6,364,530 B1 4/2002 Buchman
6,378,177 B1 4/2002 Athans et al.
6,389,780 B1 5/2002 Coomber et al.
6,412,254 B1 7/2002 Tilman et al.
6,431,754 B1 8/2002 Svicki, Sr.
6,449,924 B2 9/2002 McMahon et al.
6,461,042 B1 10/2002 Tomic et al.
6,733,178 B2 * 5/2004 Bois ..... 383/59
6,761,481 B1 * 7/2004 Bois ..... 383/59

* cited by examiner

AIRTIGHT ZIPPER

BACKGROUND OF THE INVENTION

The present invention relates to zippered bags, and more particularly, to a zipper profile used in connection with such bags. It is known to use airtight plastic bags and containers to conveniently store bulky materials such as clothing and bedding. Airtight plastic bags are also known to store food and other materials. Examples of such airtight bags are disclosed in U.S. Pat. Nos. 6,357,915; 6,116,781; and 5,480,030, each of which is incorporated herein by reference. Airtight bags allow air to be removed from bulky items such as comforters and sweaters, and the bag sealed to essentially "shrink" the items stored inside the bag. Air can be compressed from the contents, for example, by rolling the contents prior to closing the bag. The bags may also have a one-way valve to which a vacuum attachment can be affixed to evacuate the air from inside the bag using a conventional household vacuum cleaner or a specially designed pump. Removal of air reduces the amount of space necessary to store the items. When food items are stored, preventing air from reaching the food items can prolong their freshness. Air can be squeezed or pumped from the food storage bag prior to closing. The above bags are typically made of materials such as bi-axial layers of nylon and polyethylene to make the bags air and moisture impermeable, and hold the airtight vacuum seal.

The bags have a zippered closure at the mouth of the bag. Examples of zippered closures are disclosed in U.S. Pat. Nos. 6,033,113 to Anderson, and 6,059,457 to Sprehe et al, both of which are incorporated by reference herein. The zippered closure is typically made of plastic, and has a pair of zipper profiles that interlock to form the zippered closure.

Often associated with the zippered closure is a slider that facilitates sealing the zippered closure. The slider closes and can open the zippered closure. Examples of sliders include those disclosed in U.S. Pat. Nos. 6,306,071; 6,287,001; 6,264,366; 6,247,844; 5,950,285; 5,924,173; 5,836,056; 5,442,837; 5,161,286; 5,131,121; 5,088,971; and 5,067,208.

It is well known in the art of bagmaking to crush the ends of the zippered closures. The bags are longitudinally cut at the crushed sections or "end stomps" to create separate bags which typically are formed in a continuous web. When the zippered closure ends are crushed, the zippered closure is melted and deformed in such areas. The act of crushing results in voids in the transition zone between the end stomp and the intact zipper profile through which air can travel. Thus, the bags will not be airtight.

As disclosed in Sprehe, typical zippers include flanges that extend from the zipper profile that secure the zippers profiles to the bag film, and ostensibly to provide excess plastic material to fill any voids during crushing. The use of flanges results in several problems. Because the flanges are relatively thin, the bag is attached at a weak area of the profile. Moreover, the gap between the flanges needs to be filled when crushing the ends. The flanges disclosed in Sprehe and Anderson, and the filler disclosed in Anderson also result in increases in the zipper cost. The zipper profile of the present invention solves these and other problems.

SUMMARY OF THE INVENTION

The present invention provides a zippered closure comprising a front zipper profile and a back zipper profile. The front and back zipper profiles each have a facing side and an attaching side. The front and back zipper profiles interlock along their facing sides. The facing side of at least one of the front and back zipper profiles is wider than its attaching side.

In another aspect, the present invention provides A bag having a mouth and a zippered closure at the mouth. The zippered closure includes a front zipper profile and a back zipper profile. The front and back zipper profiles each have a facing side and an attaching side. The front and back zipper profiles interlock along their facing sides. The facing side of at least one of the front and back zipper profiles is wider than its attaching side.

The present invention also provides a method of making a bag having a zippered closure comprising the steps of providing a first bag film, and providing a second bag film in substantial registration with the first bag film. The method also includes the steps of providing a zippered closure having a front zipper profile and a back zipper profile, and guiding the zippered closure to a desired location between the first bag film and second bag film. The method further includes attaching the front zipper profile to the first film and the back zipper profile to the second film.

Additional features and advantages of the present invention are described in, and will be apparent from, the following Detailed Description of the Invention and the figures.

DETAILED DESCRIPTION OF THE INVENTION

Figure 1:
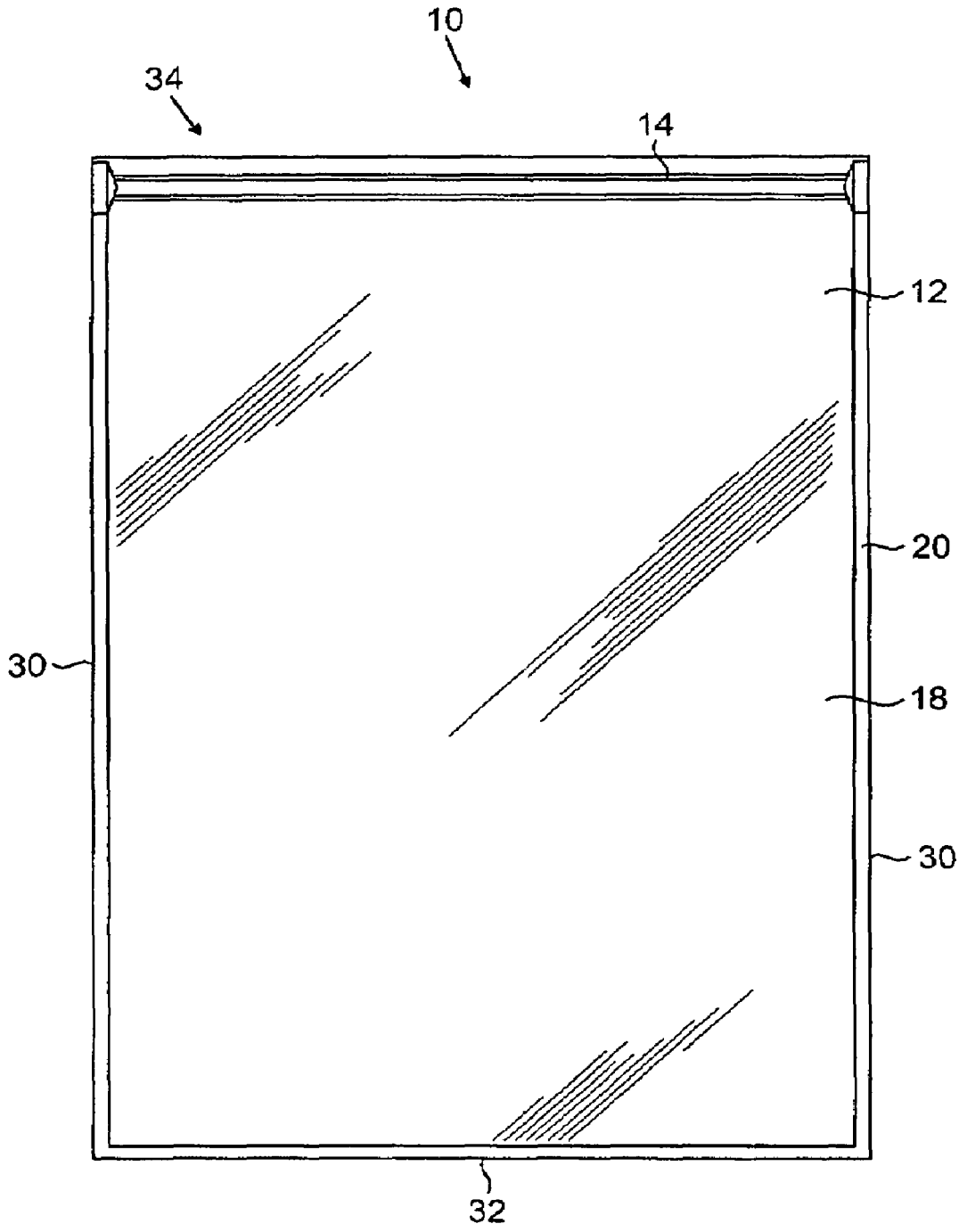
FIG. 1 is a plan view of a bag made in accord with an embodiment of the present invention.
Figure 4:
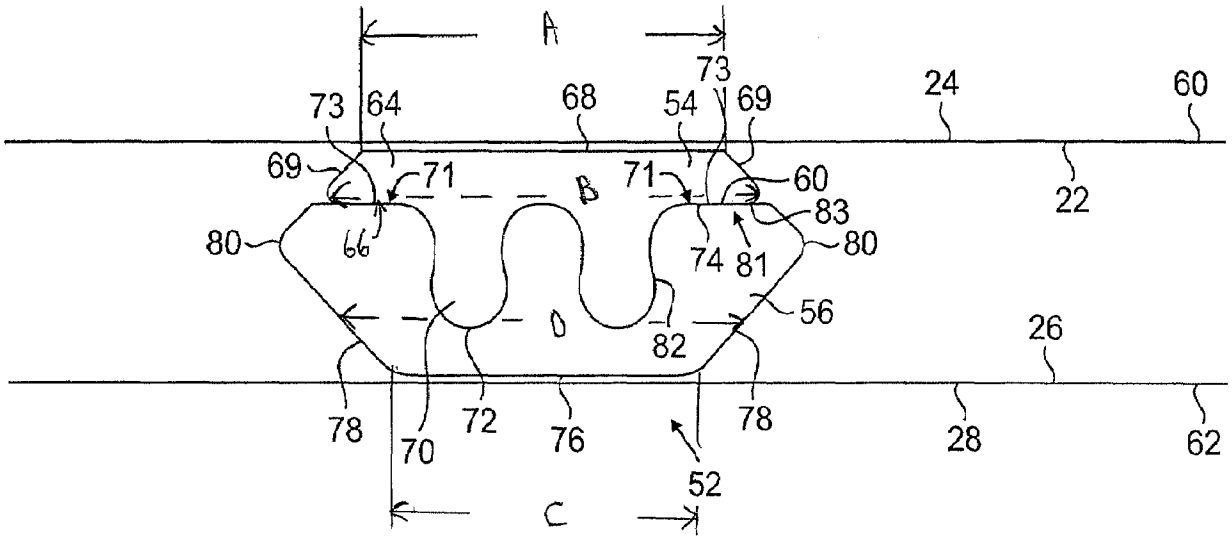
FIG. 4 is a schematic side view of a zippered closure of an embodiment of the present invention.

FIG. 1 shows a bag assembly 10 made in accord with an embodiment of the present invention. The bag assembly 10 includes a bag 12, and a zippered closure 14. The bag 12 is formed from a front 18 and a back 20. The front 18 has an inner surface 22 and an outer surface 24. The back 20 has an inner surface 26 and an outer surface 28 (FIG. 4).

The front 18 and back 20 are preferably placed in registration and sealed along their side edges 30 and bottom 32 to form the bag 12. Any suitable means to seal the front 18 and back 20 may be used, but they are preferably heat sealed. The bag 12 has a mouth 34 which is not sealed.

The front 18 and back 20 may be a monolayer structure or a multiple layer structure. The multiple layer structures can be formed by coextrusion, extrusion, lamination, extrusion lamination, or other processes well known in the art. The front 18 and back 20 are preferably each made from bi-axial layers of polyethylene and nylon, but may be any suitable material or combination of materials.

Figure 2:
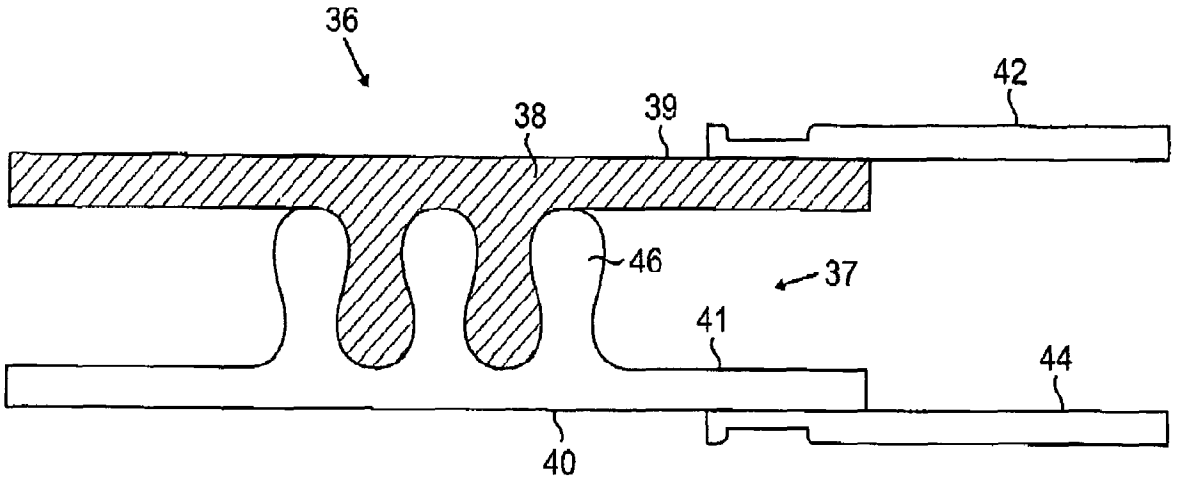
FIG. 2 (PRIOR ART)
FIG. 2 is a schematic side view of a prior art zippered closure.
Figure 3:
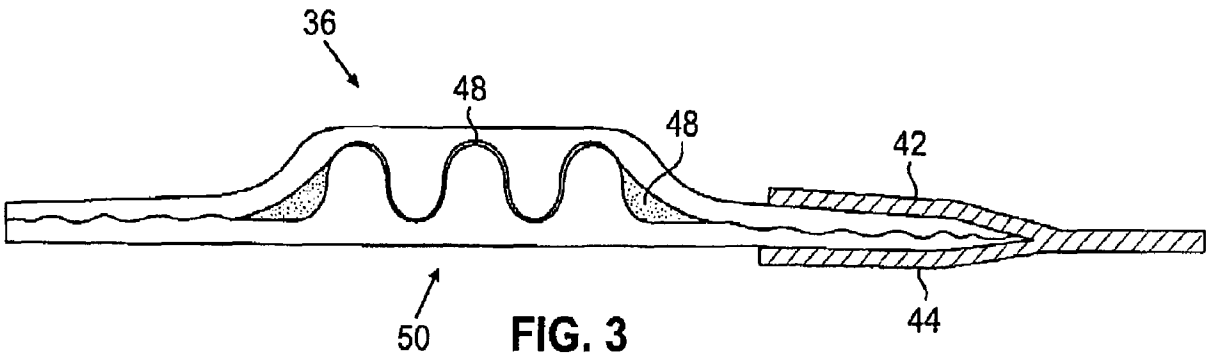
FIG. 3 (PRIOR ART)
FIG. 3 is a schematic side view of a prior art zippered closure after crushing.

FIGS. 2 and 3 show schematic views of a prior art zippered closure 36 located at the mouth of a bag 37. As shown in cross-section in FIG. 2, the zippered closure 36 includes first and second zipper profiles 38 and 40, having flanges 39 and 41. The first zipper profile 38 is attached to a first bag film 42 at one end. The second zipper profile 40 is attached to a second bag film 44 at one end. The first and second zipper profiles 38 and 40 each have a plurality of interlocking fingers 46.

FIG. 3 shows a cross-section of an end of the zippered closure 36 after crushing. After crushing, gaps 48 are left between a crushed portion 50 of the zippered closure 36 and the intact portions of the zippered closure 36 which permit air to pass through.

FIG. 4 shows in cross-section the zippered closure 52 of an embodiment of the present invention before crushing. The zippered closure 52 includes a front zipper profile 54 and a back zipper profile 56. The front zipper profile 54 is attached to a first bag film 60, and the back zipper profile 56 is attached to a second bag film 62. The front and back zipper profiles 54 and 56 may be attached to their respective bag films 60 and 62 by any suitable means. In a preferred embodiment, the front and back zipper profiles 54 and 56 are attached by heat sealing to the first and second bag films 60 and 62. The front and back zipper profiles 54 and 56 are made of a plastic material, preferably polyethylene, but any suitable material may be used.

The first zipper profile 54 includes a base portion 64. The base portion 64 has a facing side 66 and an attaching side 68. In the preferred embodiment, the facing side 66 is wider than the attaching side 68, (see lines A and B), resulting in angled edges 69 of the first zipper profile 54. The attaching side 68 is generally flat and is attached to the first bag film 60. The facing side 66 includes at least one, and preferably a plurality of fingers 70 extending generally perpendicular from the facing side 66 along its length. In a preferred embodiment, the fingers 70 are rounded at top edges 72.

In a preferred embodiment, the back zipper profile 56 has a facing side 74 and an attaching side 76. The attaching side 76 is generally flat and is attached to the second bag film 62. The facing side 74 is wider than the attaching side 76 (see lines C and D). The facing side 74 of the back zipper profile 56 is also preferably wider than the facing side 66 of the front zipper profile 54. In a preferred embodiment, the back zipper profile 56 has edges 78. From the attaching side 76, the edges 78 extend outwardly to a point 80, and then extend inwardly toward facing side 74. The back zipper profile 56 also includes at least one, and preferably a plurality of channels 82 extending along its length. Channels 82 are adapted to accept and interlock with the fingers 70 of the front zipper profile 54 to close the zippered closure 14.

Figure 5:
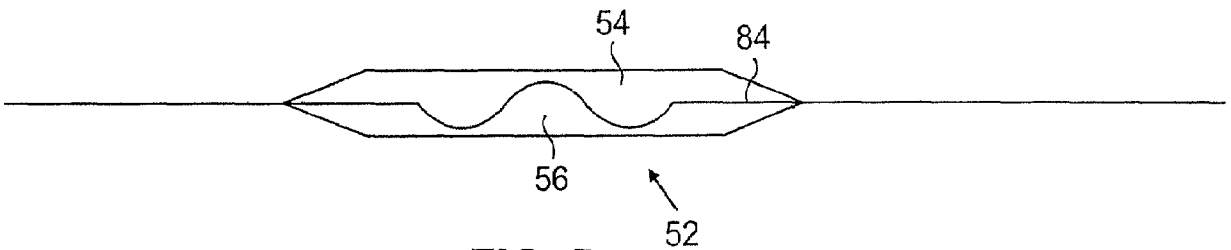
FIG. 5 is a schematic side view of a zippered closure of an embodiment of the present invention after crushing.

FIG. 5 shows in cross-section an end of the zippered closure 14 after crushing. The front and back zipper profiles 54 and 56 melt along a melt line 84. As shown in FIG. 5, the configuration of the front and back zipper profiles 54 and 56 permit zipper profile material to fill in any gaps that may occur during crushing. Moreover, because the zippered closure 14 of the present invention lacks prior art flanges, air gaps created by the prior art flanges are eliminated.

Figure 6:
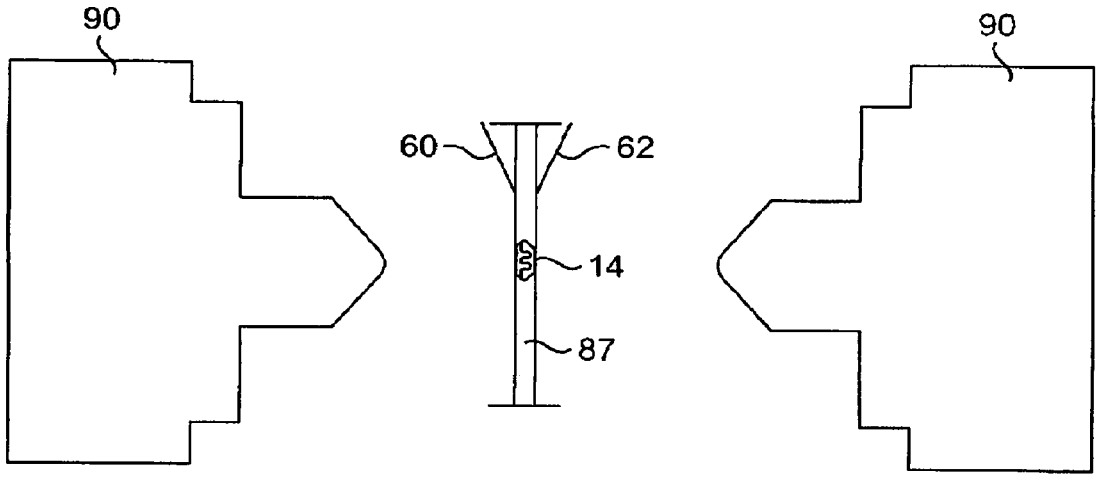
FIG. 6 is a schematic view of a method of making a zippered closure of an embodiment of the present invention.
Figure 7:
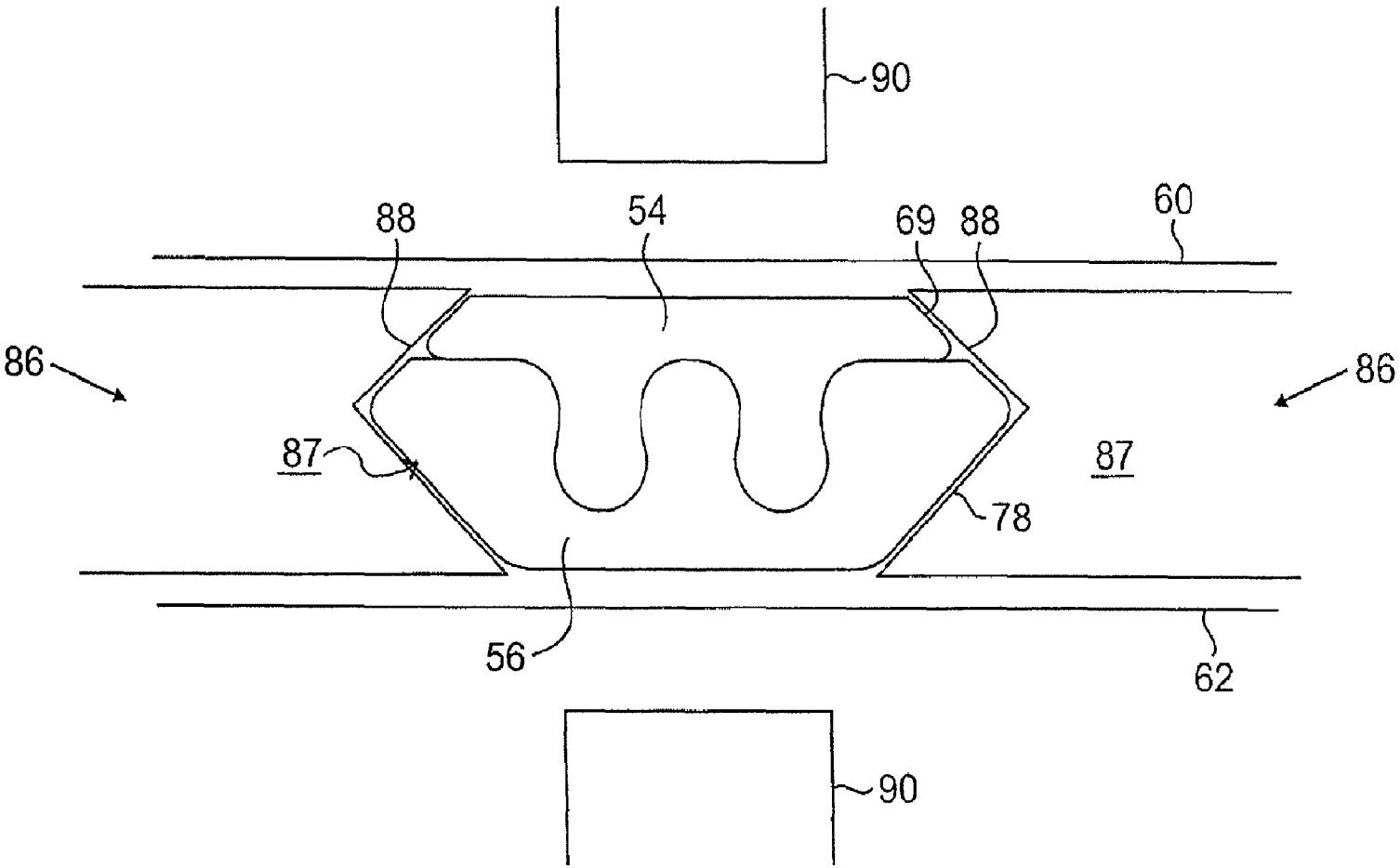
FIG. 7 is an enlarged schematic view of FIG. 6 showing a method of making a zippered closure in accord with an embodiment of the present invention.

FIGS. 6 and 7 show in schematic a method of making a bag in accord with an embodiment of the present invention. The first bag film 60 and second bag film 62 are placed generally in registration. The zippered closure 14 is fed through a guide 86 which accommodates the front and back zipper profiles 54 and 56. In a preferred embodiment, the front and back zipper profiles 54 and 56 are interlocked prior to being introduced to the guide 86. The guide 86 is positioned between the first and second bag films 60 and 62 such that the zippered closure 14 is located where desired with respect to the bag films 60 and 62, preferably near the mouth of the bag. The guide 86 includes a pair of rods 87 with generally inverted arrow shaped ends 88. The ends 88 are shaped to accommodate the shapes of the edges 69 and 78 of the front and back zipper profiles 54 and 56. The guide 86 is preferably made of steel, though any suitable material may be used.

In a preferred embodiment, heat sealing elements 90 are positioned above the first bag film 60 and below the second bag film 62. The heat sealing elements can be rollers like those disclosed in U.S. Pat. No. 6,033,113. The heat sealing elements 90 are applied to the bag films 60 and 62, thereby heat sealing the front and back profiles 54 and 56 to their respective bag films 60 and 62. A preferred heat sealing temperature range is between 350 and 400 degrees Fahrenheit. In a separate process, the ends of the zippered closure 14 are crushed. Heat sealing the front and back profiles 54 and 56 to the bag films 60 and 62, as well as crushing may be performed by any suitable process known in the art such as heat sealing or ultrasonic welding.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. A zippered closure comprising:

a front zipper profile having a base portion and a finger extending from the base portion and positioned between lateral ends of the base portion, the base portion having a substantially flat facing side surface and an attaching side surface opposite the facing side surface, the finger extending in a generally transverse direction from the facing side surface of the base portion;

a back zipper profile having a base with opposed ends and two opposed flanges with a channel formed therebetween, the base having a generally flat attaching side surface and opposed lateral ends with each of the two opposed flanges respectively extending from each lateral end, each of the two flanges having opposed lateral edges that extend upwardly and outwardly from the base to an intermediate point in a thickness direction at which point the opposed lateral edges extend laterally inwardly and terminate in an upwardly facing side surface, a first distance measured along a line parallel to the base and connecting points of the opposed lateral edges is greater than a second distance measured between the opposed ends of the base;

wherein the channel extends from the facing side surface towards the attaching side surface; and wherein the finger is positioned in the channel and the substantially flat facing side surface of the front zipper profile abuts the substantially flat facing side surface of the back zipper profile.

2. The zippered closure of claim 1, wherein the attaching side of the front zipper profile is attached to a first bag film, and the attaching side of the back zipper profile is attached to a second bag film.

3. The zippered closure of claim 1, wherein the finger is rounded at its top edges.

4. The zippered closure of claim 1, wherein the facing side surface of the front zipper profile is wider than the attaching side surface.

5. A bag, the bag having a mouth and a zippered closure at the mouth, the zippered closure comprising:

a front zipper profile having a base portion and a finger extending from the base portion and positioned between lateral ends of the base portion, the base portion having a substantially flat facing side surface and an attaching side surface opposite the facing side surface, the finger extending in a generally transverse direction from the facing side surface of the base portion;

a back zipper profile having a base with opposed ends and two opposed flanges with a channel formed therebetween, the base having a generally flat attaching side surface and opposed lateral ends with each of the two opposed flanges respectively extending from each lateral end, each of the two flanges having opposed lateral edges that extend upwardly and outwardly from the base to an intermediate point in a thickness direction at which point the opposed lateral edges extend laterally inwardly and terminate in an upwardly facing side surface, a first distance measured along a line parallel to the base and connecting points of the opposed lateral edges is greater than a second distance measured between the opposed ends of the base;

wherein the finger is positioned in the channel and the substantially flat facing side surface of the front zipper profile abuts the substantially flat facing side surface of the back zipper profile.

6. The bag of claim 5, wherein the attaching side of the front zipper profile is attached to a first bag film, and the attaching side of the back zipper profile is attached to a second bag film.

7. The bag of claim 5, wherein the finger is rounded at its top edges.

8. The bag of claim 5, wherein the facing side surface of the front zipper profile is wider than the attaching side surface.

9. A method of making a bag having a zippered closure comprising the steps of:

providing a first bag film;

providing a second bag film in substantial registration with the first bag film;

providing a zippered closure having a front zipper profile and a back zipper profile, the front zipper profile having a base portion and a finger extending from the base portion and positioned between lateral ends of the base portion, the base portion having a substantially flat facing side surface and an attaching side surface opposite the facing side, the finger extending in a generally transverse direction from the facing side surface of the base portion, the back zipper profile having a base with opposed ends and two opposed flanges with a channel formed therebetween, the base having a generally flat attaching side surface and opposed lateral ends with each of the two opposed flanges respectively extending from each lateral end, each of the two flanges having opposed lateral edges that extend upwardly and outwardly from the base to an intermediate point in a thickness direction at which point the opposed lateral edges extend laterally inwardly and terminate in an upwardly facing side surface, a first distance measured along a line parallel to the base and connecting points of the opposed lateral edges is greater than a second distance measured between the opposed ends of the base, wherein the finger is positioned in the channel and the substantially flat facing side surface of the front zipper profile abuts the substantially flat facing side surface of the back zipper profile;

guiding the zippered closure to a desired location between the first bag film and second bag film; and attaching the front zipper profile to the first film via the front zipper profile attaching side surface and the back zipper profile to the second film via the second zipper profile attaching side surface.

10. The method of claim 9, wherein the attaching side of the front zipper profile is attached to the first bag film, and the attaching side of the back zipper profile is attached to the second bag film.

11. The method of claim 9, wherein the finger is rounded at its top edges.

12. The method of claim 9, wherein the step of attaching is performed by heat sealing the front zipper profile to the first film and the back zipper profile to the second film.

13. The method of claim 9, wherein the step of guiding includes a guide having ends shaped to accommodate edges of the front and back zipper profiles.

14. The method of claim 13, wherein the guide includes a pair of rods, and the ends have an inverted arrow shape.

15. The method of claim 9, wherein the facing side surface of the front zipper profile is wider than the attaching side surface.

* * * * *